US005899646A

United States Patent [19]

Tatina et al.

[11] Patent Number: 5,899,646

[45] Date of Patent: May 4, 1999

[54] SECUREMENT OF LUMBER OR LIKE PRODUCTS ON CENTERBEAM RAILCARS USING SPOOLED WEBBING

[75] Inventors: Richard A. Tatina, Countryside; Eugene J. Korzenko, Oak Forest, both of Ill.

[73] Assignee: Portec Rail Products, Inc., Oak Brook, Ill.

[21] Appl. No.: 08/813,087

[22] Filed: Mar. 7, 1997

[51] Int. Cl.[6] ..... B60P 7/08

[52] U.S. Cl. ..... 410/100; 410/97; 410/103

[58] Field of Search ..... 410/96, 97, 100, 410/102, 103, 12; 105/355, 404; 254/323; 24/68 CD, 265 CD

[56] References Cited

U.S. PATENT DOCUMENTS

| | | | |
|---|---|---|---|
| 3,407,753 | 10/1968 | Stafford, Jr. | 410/100 X |
| 3,416,816 | 12/1968 | Spencer | 410/100 |
| 3,685,799 | 8/1972 | Wriedt | 410/97 |
| 4,382,736 | 5/1983 | Thomas | 410/104 |
| 4,802,420 | 2/1989 | Butcher et al. | 105/355 |
| 5,024,567 | 6/1991 | Dominguez et al. | 410/100 |
| 5,186,586 | 2/1993 | Stephenson, Jr. | 410/100 |
| 5,314,275 | 5/1994 | Cottrell et al. | 410/103 X |
| 5,460,465 | 10/1995 | Little | 410/100 |
| 5,490,749 | 2/1996 | Arbues | 410/103 |
| 5,626,083 | 5/1997 | Saxton | 105/355 |

OTHER PUBLICATIONS

Color Photograph of Railcar, 1 sheet.

*Primary Examiner*—Stephen T. Gordon
*Attorney, Agent, or Firm*—Hill & Simpson

[57] ABSTRACT

A securement system for a centerbeam railcar for securing lumber or like products includes overhead spools for holding polyester webbing straps, and columns arranged along a length of the railcar having horizontally arranged intermediate web posts for receiving the straps partially wrapped around the intermediate web posts, and winches secured to a bottom side sill of the floor structure of the railcar for receiving an end of the webbing straps to pull the webbing straps tight on the cargo. A plurality of the intermediate web posts are provided vertically arranged to change the effective holding shape of the web onto a varying cargo height.

20 Claims, 4 Drawing Sheets

10
12
14
15
16
17
18
20
22
24
III
IV
VI

SECUREMENT OF LUMBER OR LIKE PRODUCTS ON CENTERBEAM RAILCARS USING SPOOLED WEBBING

BACKGROUND OF THE INVENTION

The present invention relates to securement of lumber or like products on railcars, and in particular for securing lumber on centerbeam railcars using a spooled webbing system.

The presently known securement system for securing lumber on centerbeam railcars utilizes a winch mounted to a side sill of the railcar, a length of cable with a short piece of chain at an upper end of the cable, and a metal or plastic corner protector which is free to be slid on the cable. One end of the cable is secured to the side sill mounted winch. The chain at the upper end is then inserted into the appropriate keyhole slot in a corresponding center beam after the car is loaded. Before tightening the cable, the corner protector must be positioned at the upper corner of the outside of the load. The corner protector protects from crushing or cutting of the load by the high stress of the cable pressing against the corner.

When the center beam cars is to be unloaded, the tension on the cable must first be released, the chain removed from the keyhole slot, and then the cable allowed to drop to the ground. This dropping can cause injury to workers on the ground. Unless certain precautions are taken, the cable along with the corner load protector can be inadvertently driven over and damaged by fork lift trucks during unloading. The cable assembly can also become frayed which can cause injury in handling, or it can be contaminated with mud, frequently present in lumber yards. After the railcar is unloaded, the chain must be inserted in the keyhole slot and tension applied to the cable before the car can be released.

SUMMARY OF THE INVENTION

It is an object of the present invention to provide a securement system for cargo, such as lumber, in a centerbeam railcar which provides elongate straps for securement of the load, wherein the straps are prevented from damage by fork lift traffic and also are installed in a controlled orientation to prevent accidents. It is an object of the invention to provide a webbing system which is versatile and flexible to adapt to different stacking heights of lumber or like products. It is an object of the invention to provide a securing webbing which eliminates the need for corner protectors. It is an object of the invention to provide a webbing material which is resistant to fraying. It is an object of the invention to provide a webbing securement system which is conveniently retracted for storage during non-use. It is an object of the invention to provide a webbing securement system which is safer to handle, easier to use, stronger than cable systems, eliminates the need for corner protectors, and is protected from damage and pilferage by being stored at the top of the car.

The objects of the invention are achieved by providing a system which includes a winch mounted to a side sill for applying tension to the webbing, and a specific length of 4" wide woven polyester webbing attached to a spool mounted to an upper longitudinal structure of the railcar. The spool is the anchor point for the webbing and serves as storage for the webbing during return or empty move of the railcar. The 4" wide webbing additionally spreads the securement forces at the comers of the cargo to be able to eliminate corner protectors. In operation, the centerbeam railcar with the improved securement system arrives for loading with the webbing stored in spools located at the upper longitudinal structure. After the railcar is completely loaded, the webbing is pulled from each spool, dropped over the side of the load, inserted into the corresponding side sill winch, and tension applied by turning the winch. The length of the webbing precludes it from touching the ground. If the load is less than full height, due to the density of the load and weight restriction on the car, the webbing is directed around appropriate intermediate web post and then down to the side sill mounted winch, eliminating the need for the keyslots which become deformed from the chain and are subsequently difficult to use.

At destination and before unloading can be commenced, tension is released from the webbing, the webbing is removed from the side sill mounted winch and is wound up on the storage spool by a hand crank or a battery powered tool. The webbing in the spool is prevented from inadvertently unwinding by the pressure applied to the webbing through the spring cover of the spool. The spring cover also provides some protection from the environment. When all of the webbing has been stored the car may be unloaded. Once unloaded, the car is ready to be released. There are no dangerously frayed and muddy cables to insert in the centerbeam keyslots and tensioned at the side sill.

Other objects and advantages of the present invention will be apparent upon reference to the accompanying description when taken in conjunction with the following drawings.

DETAILED DESCRIPTION OF THE PREFERRED EMBODIMENTS

Figures 1, 2:
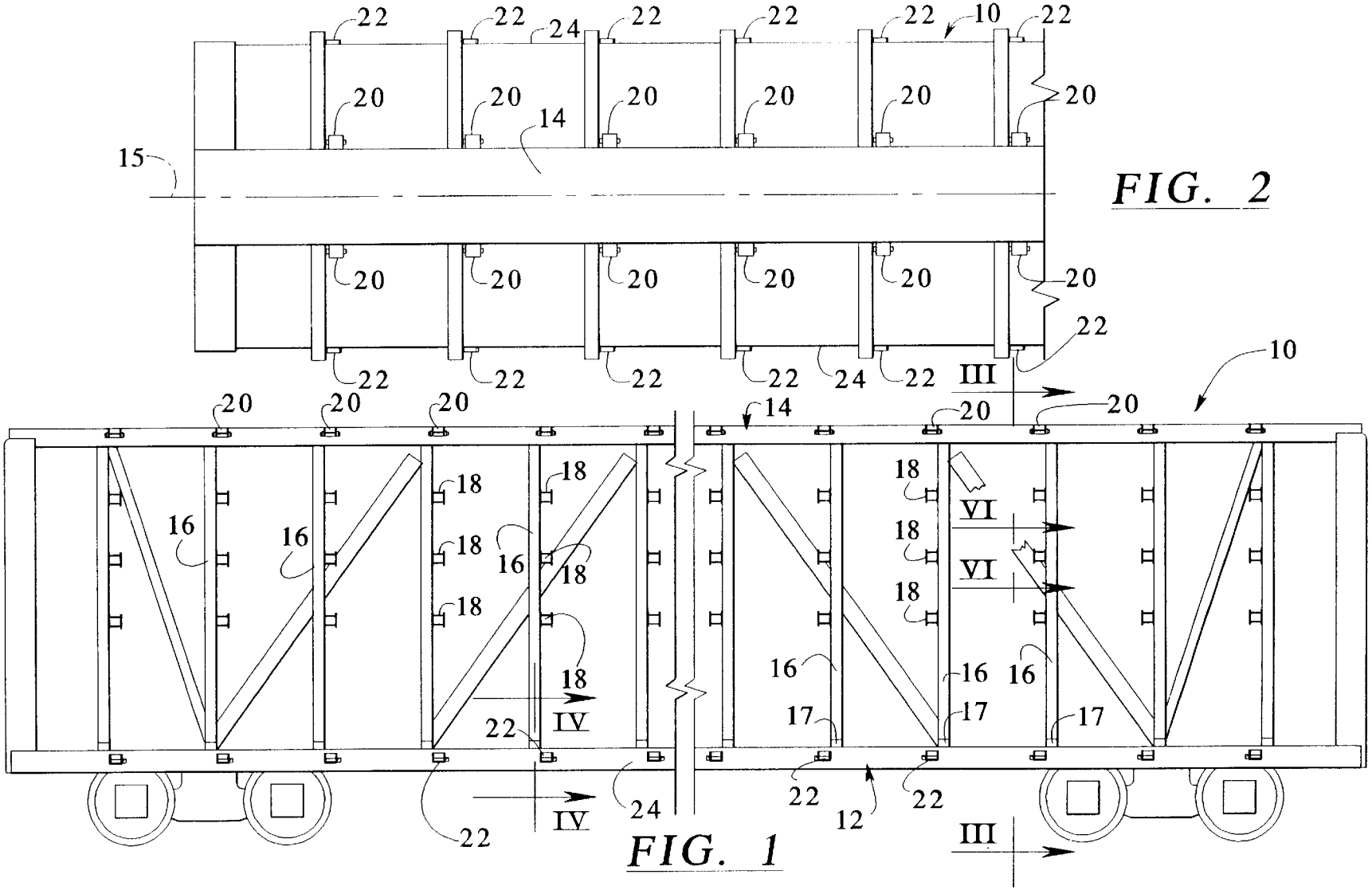
FIG. 1 is an elevational view of an empty railcar embodying the present invention.
FIG. 2 is a partial top plan view of the railcar shown in FIG. 1.

FIG. 1 illustrates a railroad car 10 having a floor structure 12 and overhead centerbeam 14 proceeding longitudinally along a centerline 15 of the car and intermediate columns 16 arranged between the floor structure 12 and the centerbeam 14. The columns 16 are arranged intermittently along the length of the car and connected to lateral floor risers 17. Arranged at incremental positions vertically on each column 16 are intermediate web posts 18. Arranged aligned in a transverse cross sectional plane with the intermediate web post 18 is a web anchor spool 20 connected to the centerbeam 14 and a winch 22 connected to a side sill 24 of the floor structure 12.

As shown in FIG. 2 the car is constructed in mirror image across its longitudinal centerline 15 such that a plurality of spaced apart winches 22 are mounted to opposite side sills of the car 10 and a plurality of spaced apart spool anchors 20 are mounted on opposite sides of the centerbeam 14.

Figure 3:
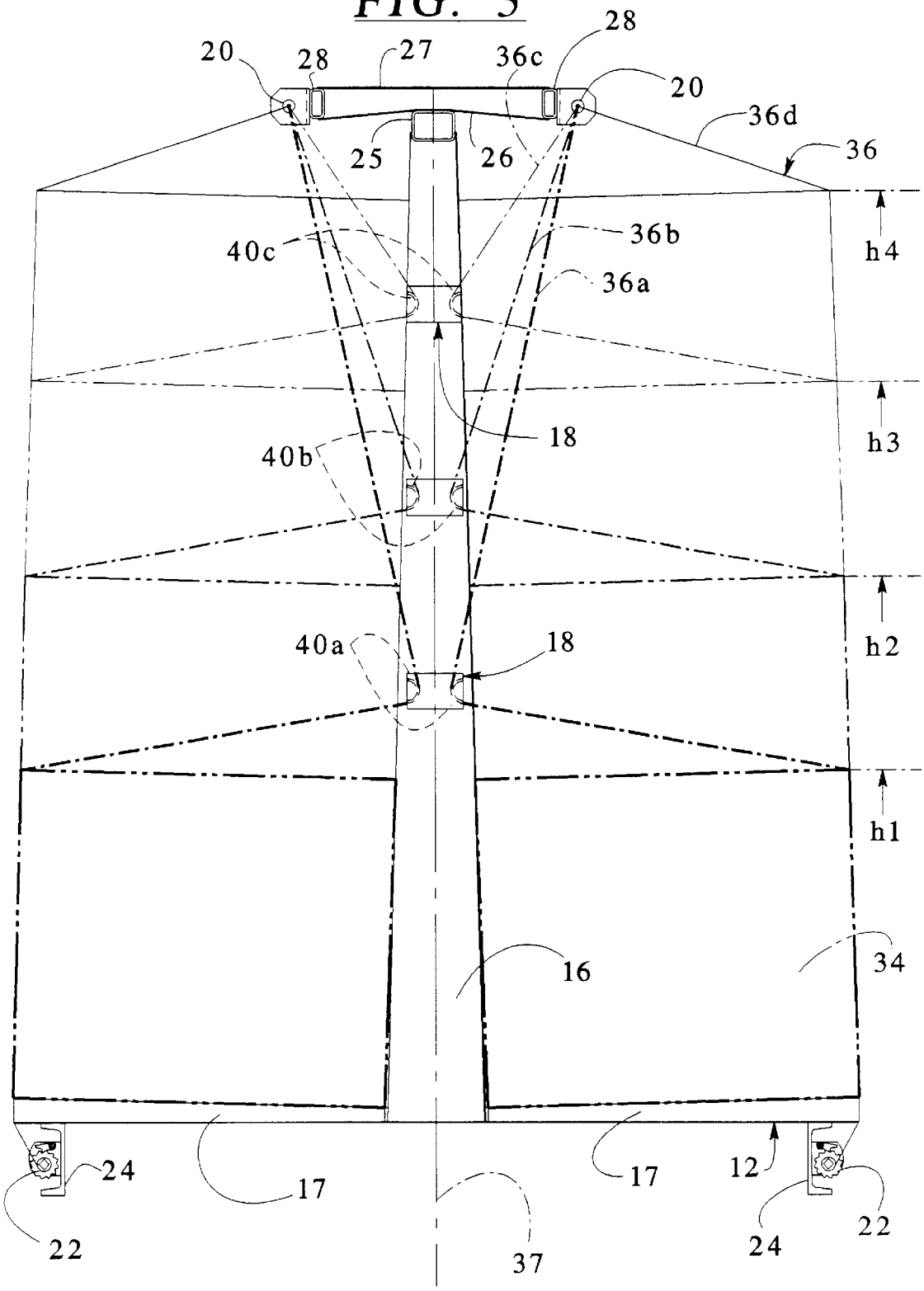
FIG. 3 is a sectional view taken generally along the line III—III of FIG. 1 with cargo loaded in car.

FIG. 3 shows the centerbeam 14 being a composite member having a lower box beam 25, lower crossplate 26, upper cross plate 27, and a pair of lateral box beams 28. Mounted to the lateral box beams 28 are the spool/anchors 20 which hold wrapped therein webbing straps as described below. The anchor spools 20 can be bolted or welded in place.

FIG. 3 shows a cargo 34 loaded on the floor structure 12, particularly on the risers 17, and secured by webbing 36 unraveled from two spools 20 in mirror image fashion across a vertical centerline 37. Only one side will be explained for simplicity. Four height levels of the cargo 34 are shown, $h_1$, $h_2$, $h_3$, $h_4$. The webbing 36 can be wrapped in different geometries 36*a,* 36*b,* 36*c,* 36*d.* For geometries 36*a, b, c,* corresponding to cargo heights $h_1$, $h_2$, $h_3$ the webbing 36 is wrapped around a select semicylindrical lug 40*a, b, c* of the intermediate posts 18 extending outwardly therefrom to an outside of the cargo 34 and downwardly to the winch 22 mounted on the side sill 24.

Figure 5:
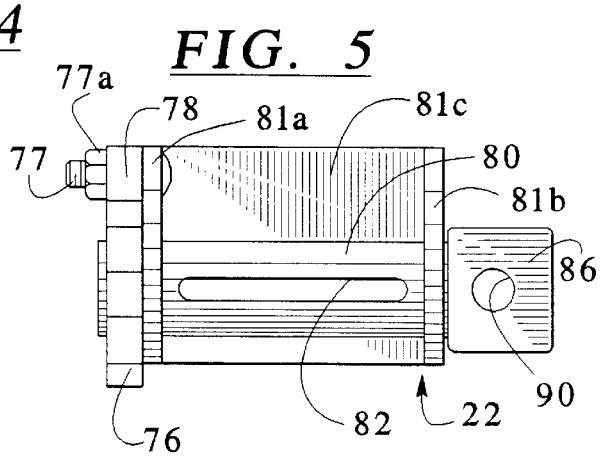
FIG. 5 is an elevational view of the winch shown in FIG. 4.

The webbing 36 is preferably 4" webbing approximately 17' long with a sewn loop at an upper end thereof and a plain end at the bottom for receipt into a slot 82 in the winch 22 as shown in FIG. 5.

Each post 18 includes oppositely facing semicylindrical lugs 40*a,* 40*b,* 40*c* for securement of loads on both sides of the intermediate columns 16 in mirror image fashion. As can be seen from this figure cargo of different heights can be accommodated by the vertically and incrementally arranged posts 18. Cargo heights can be the same or different across the centerline 37.

Figure 4:
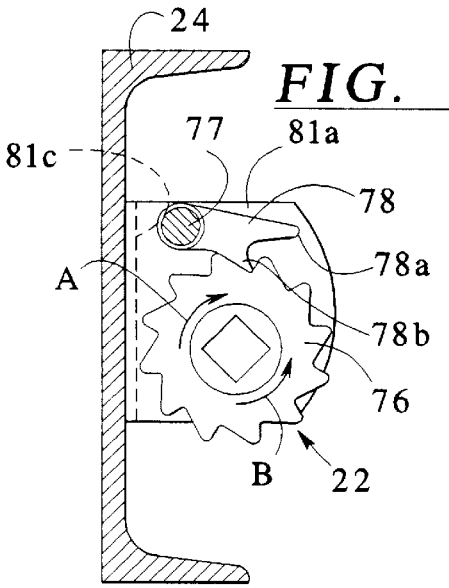
FIG. 4 is a sectional view taken generally along the line IV—IV of FIG. 1.

As shown in FIGS. 4 and 5, the winch 22 includes a ratchet wheel 76 engaged by a pawl 78 mounted by a bolt 77 and nut 77*a* to hold the rotary position of a winch spool 80. The spool 80 is fixed for rotation with the wheel 76 both of which are rotationally supported by the side brackets 81*a* and 81*b* and base plate 81*c*. The winch spool 80 includes a through-slot 82 for receiving an end of the elongate webbing 36.

The spool 80 is rotatable by a tool receptacle part 86 having a hole 90 for receiving a bar for forceable rotation by a workman. The pawl 78 permits forceable rotation of the spool 80 in the rotary direction A but prevent rotation in the rotary direction B. The pawl 78 can be manually lifted for allowing rotation of the wheel 76 in the direction B to release tension and remove the webbing 36 from the slot 82. The pawl 78 is lifted by the lever 78*a* to retract the lug 78*b*.

Figure 6:
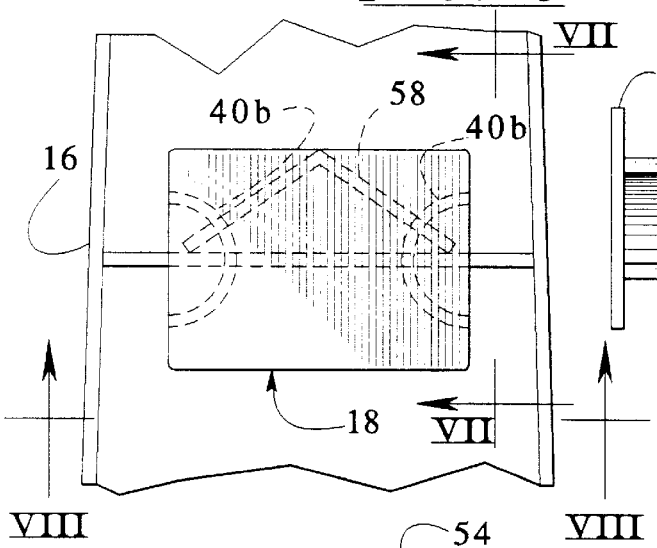
FIG. 6 is a sectional view taken generally along the line VI—VI of FIG. 1.
Figure 7:
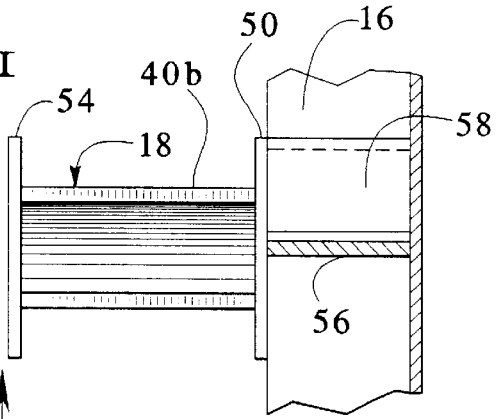
FIG. 7 is a sectional view taken generally along the line VII—VII of FIG. 6.
Figure 8:
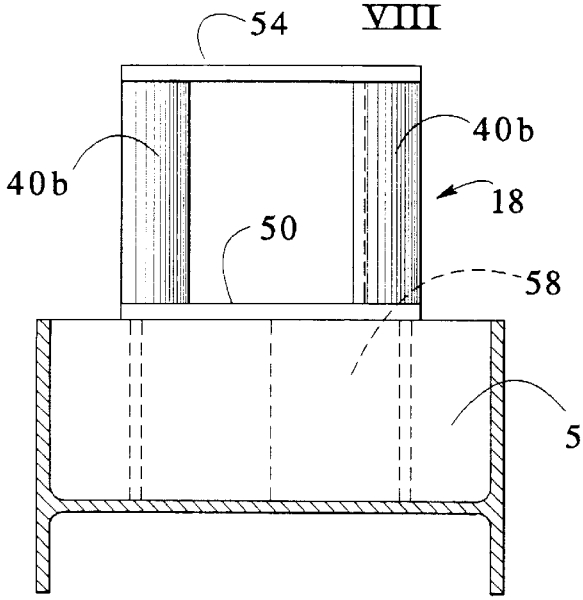
FIG. 8 is a sectional view taken generally along VIII—VIII of FIG. 6.

As shown in FIGS. 6–8, the posts 18 are secured such as by welding, to the column 16 via a base plate 50. An outside plate 54 guides the webbing 36 on the semicylindrical lug 40*b,* i.e., to preventing slipping off. A horizontal reinforcing plate 56 and V-shaped reinforcing plate 58 are welded to the column 16 and to the base plate 50 for strengthening the mounting of the post 18. The post 18 are all fashioned and mounted substantially identically.

Preferably, the webbing is a woven polyester webbing 4" wide which prevents concentrated load damage to the cargo at its upper corner.

Figure 9:
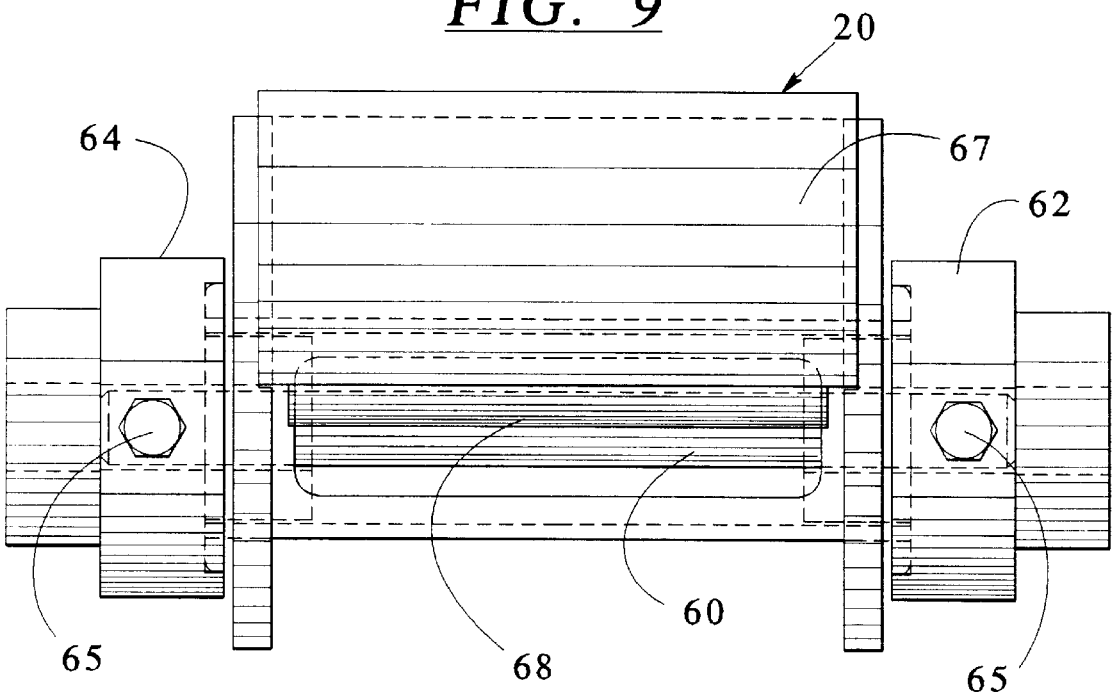
FIG. 9 is an enlarged elevational view of a webbing anchor storage spool according to the present invention.
Figure 10:
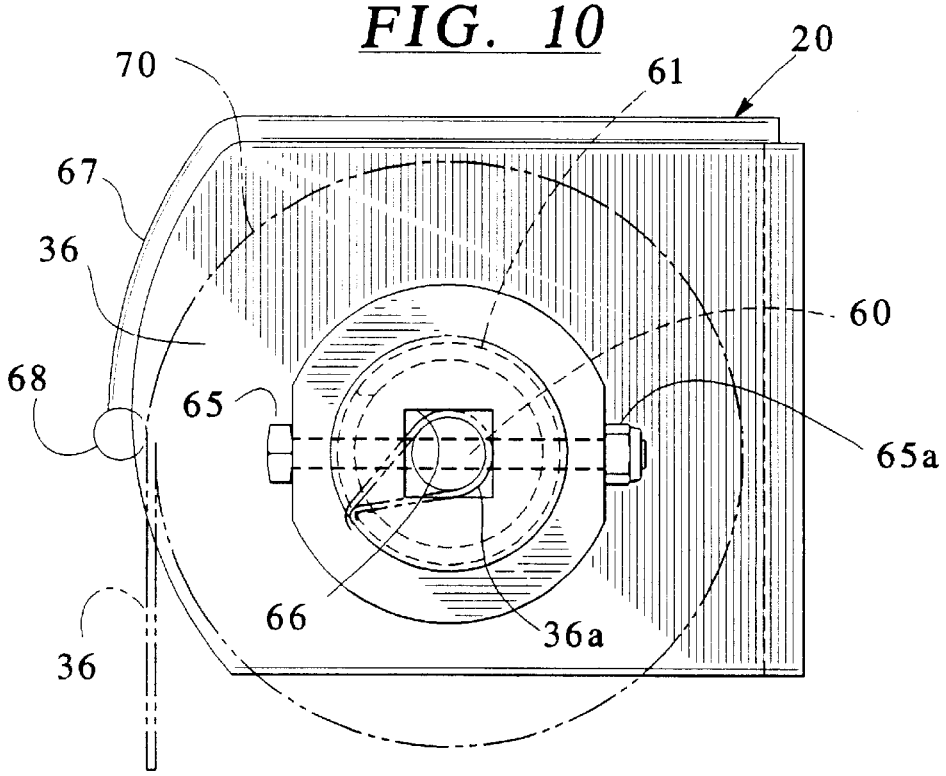
FIG. 10 is a side view of the storage spool shown in FIG. 9.

FIG. 9 shows the spool/anchor 20 in more detail including a shaft 60 for being received by a loop end 36*a* of the webbing 36, a spindle 61 for coiling the webbing, and retainers 62, 64 for maintaining the shaft 60 in place. The retainers 62, 64 can individually be removed to remove the shaft for replacing the webbing. The retainers 62, 64 are fixed to the spindle 61 and shaft 60 by through bolts 65 with nuts 65*a*. The bolts 65 pierce the retainers 62, 64, the spindle 61 and the shaft 60 through registering holes thereof.

The retainers 62, 64 and thus the spindle 61 and shaft 60 are rotated by way of a tool socket 66, shown as a square socket, by a hand tool or power tool to coil or uncoil the webbing 36. A resilient cover 67 retains the webbing in position once coiled on the spool. The cover 67 includes a pressing cylindrical bar 68 for resiliently pressing a wrapped outer circumference 70 of the webbing 36. Alternately, a weighted bar 68 could be used to press the wrapped outer circumference 70 of the webbing 36.

As is apparent from the foregoing specification, the invention is susceptible of being embodied with various alterations and modifications which may differ particularly from those that have been described in the preceding specification and description. It should be understood that we wish to embody within the scope of the patent warranted hereon, all such modifications as reasonably and properly come within the scope of our contribution to the art.

We claim as our invention:

1. A securement system for cargo held on a platform, the platform having an overhead frame connected thereto via a vertical structure system, comprising:

a plurality of spools mounted along a length of said overhead frame, each of said spools holding a respective coiled web therein in a non-use position;

a plurality of winches located at said platform for receiving a respective one of said webs when uncoiled from said spools for pulling tight said respective web against cargo held on said platform;

said vertical structure system having intermediate web posts, respectively arranged in alignment with a respective one of said spools and a respective one of said winches for receiving said respective web wrapped therearound between said respective spool and said respective winch; and said vertical structure system having further intermediate web posts arranged below said respective web posts for providing an alternate location for wrapping said respective webs.

2. A securement system for cargo held on a transport, comprising:

at least one spool mounted fixedly on said transport above said cargo;

at least one winch mounted fixedly on said transport near a bottom of said cargo;

a webbing coiled on said spool during non-use and unwindable to extend along a first side of said cargo to be engaged by said winch for tightening said webbing against said first side of said cargo; and said spool including a spring loaded retainer for resiliently pressing a wound circumference of said webbing on said spool to prevent unwinding therefrom during non-use of said webbing.

3. A securement system for cargo held on a transport, comprising:

at least one spool mounted fixedly on said transport above said cargo;

at least one winch mounted fixedly on said transport near a bottom of said cargo;

a webbing coiled on said spool during non-use and unwindable to extend along a first side of said cargo to be engaged by said winch for tightening said webbing against said first side of said cargo;

a first web post extending horizontally and fixed vertically on said transport between said spool and said winch on a second side of said cargo opposite said first side, said first web post being aligned with said spool and said winch in a lateral direction and having a wrapping surface for receiving said webbing partially therearound; and a second web post extending horizontally and fixed vertically on said transport between said spool and said winch on said second side of said cargo, said second web post arranged beneath said first web post and having a wrapping surface for receiving said webbing partially therearound.

4. A securement system for cargo held on a platform, the platform having a central vertical structure system extending upwardly therefrom, comprising:

a first spool mounted at a top of said vertical structure system at one side thereof and a second spool mounted at the top of said vertical structure system at a second opposite side thereof, the first and second spools each holding a respective coiled web therein when the coiled web is in a non-use position, and wherein one end of the respective web is fixedly connected to the respective spool;

a first winch located at one side of said platform and a second winch located at a second opposite side of said platform, the first and second winches receiving respective webs from the first and second spools when the webs are uncoiled from the spools, the first and second winches pulling the respective webs tight against a first cargo held at one side of said vertical structure system on the platform and a second cargo held on an opposite side of said vertical structure system on the platform.

5. A securement system according to claim 4, wherein the vertical structure system supports an overhead frame and wherein a plurality of said first spools and a plurality of said second spools are provided along first and second opposite sides of said overhead frame and wherein a plurality of said first and second winches are provided at first and second opposite sides of the platform corresponding to the plurality of first and second spools.

6. The securement system according to claim 4 wherein the vertical structure system has a cross piece at the top thereof and the first and second spools are provided at first and second opposite ends of the cross piece.

7. The securement structure according to claim 6 wherein the vertical structure system has first and second intermediate web posts for receiving thereon the respective first and second webs prior to the webs wrapping around the first and second cargos.

8. The securement system according to claim 7 wherein said first and second intermediate web posts comprise a semicylindrical wrapping surface.

9. The securement system according to claim 7 wherein the first and second intermediate web posts are horizontal.

10. A securement system for cargo held on a platform, the platform having a central vertical structure system extending upwardly therefrom, comprising:

a first spool mounted at a top of said vertical structure system at one side thereof and a second spool mounted at the top of said vertical structure system at a second opposite side thereof, the first and second spools each holding a respective coiled web therein when the coiled web is in a non-use position;

a first winch located at one side of said platform and a second winch located at a second opposite side of said platform, the first and second winches receiving respective webs from the first and second spools when the webs are uncoiled from the spools, the first and second winches pulling the respective webs tight against a first cargo held at one side of said vertical structure system on the platform and a second cargo held on an opposite side of said vertical structure system on the platform;

the vertical structure system having first and second intermediate web posts for receiving thereon the respective first and second webs prior to the webs wrapping around the first and second cargos; and a further respective web post being arranged below each of the first and second web posts and which provides an alternate location for wrapping said respective first and second webs.

11. The securement system according to claim 6 wherein said vertical structure system is arranged along a longitudinal center line of said platform.

12. A securement system for cargo held on a platform, the platform having a central vertical structure system extending upwardly therefrom, comprising:

a first spool mounted at a top of said vertical structure system at one side thereof and a second spool mounted at the top of said vertical structure system at a second opposite side thereof, the first and second spools each holding a respective coiled web therein when the coiled web is in a non-use position;

a first winch located at one side of said platform and a second winch located at a second opposite side of said platform, the first and second winches receiving respective webs from the first and second spools when the webs are uncoiled from the spools, the first and second winches pulling the respective webs tight against a first cargo held at one side of said vertical structure system on the platform and a second cargo held on an opposite side of said vertical structure system on the platform; and said first and second spools each including a spring loaded retainer for resiliently pressing a wound circumference of said web on said spool to prevent unwinding thereof during non-use of said respective first and second webbings.

13. The securement system according to claim 4 wherein said first and second winches each comprise a ratchet wheel connected to a winch spool and a cooperating pawl for permitting a rotation of said winch spool in a first direction only for tightening said respective first and second webbings.

14. A securement system for cargo held on a transport having a platform, said platform having a vertical structure system extending upwardly therefrom against which said cargo abuts, comprising:

at least one spool mounted fixedly at an upper end of said vertical structure system above said platform, said at least one spool holding a coiled web when the web is in a non-use position, and wherein one end of the web is fixedly connected to the spool;

at least one winch mounted fixedly at said platform laterally spaced from said vertical structure system; and when the webbing is uncoiled from said at least one spool, said webbing passing around said cargo which abuts against said vertical structure system and then to said at least one winch for tightening said webbing against a side of said cargo to secure said cargo between said webbing and said vertical structure system.

15. The securement system according to claim 14 wherein the vertical structure system has at least one web post extending horizontally such that the web when it is uncoiled from the spool passes from the spool down and around the at least one web post, and then along a side of the cargo after which it is engaged by the winch.

16. The securement system according to claim 14 wherein the winch is located at a side edge of said platform.

17. The securement system according to claim 16 wherein the winch is located beneath the platform at the side edge thereof.

18. A securement system for cargo held on a platform, the platform having a vertical structure system extending upwardly therefrom against which said cargo abuts, comprising:

at least one spool mounted fixedly at an upper end of said vertical structure system above said platform, said at least one spool holding a coiled web when the web is in a non-use condition;

at least one winch mounted fixedly at said platform laterally spaced from said vertical structure system;

when the webbing is uncoiled from said at least one spool, said webbing passing around said cargo which abuts against said vertical structure system and then to said at least one winch for tightening said webbing against a side of said cargo to secure said cargo between said webbing and said vertical structure system; and a friction apparatus applying friction for preventing the web on the spool from inadvertently uncoiling unless it is pulled off by a user.

19. The securement system according to claim 14 wherein when one end of the web is attached to the winch for securing the cargo, the web is fully unwound off of the spool except for an end of the web which is still attached to the spool.

20. A rail car center beam securement system, comprising:

a rail car having a platform and a center beam vertical structure system running substantially along a center of the rail car for supporting first and second cargos respectively placed on opposite sides of the center beam;

a first spool mounted at a top of said vertical structure system at one side thereof and a second spool mounted at the top of said vertical structure system at a second opposite side thereof, the first and second spools each holding a respective coiled web therein when the coiled web is in a non-use position, and wherein one end of the respective web is fixedly connected to the respective spool; and a first winch located at one side of said platform and a second winch located at a second opposite side of said platform, the first and second winches receiving respective webs from the first and second spools when the webs are uncoiled from the spools, the first and second winches pulling the respective webs tight against the first cargo held at one side of said vertical structure system on the platform and the second cargo held on an opposite side of said vertical structure system on the platform.

* * * * *